US012447375B2

(12) United States Patent
Endelman et al.

(10) Patent No.: US 12,447,375 B2
(45) Date of Patent: Oct. 21, 2025

(54) MOTORIZED REFORMER EXERCISE APPARATUS AND RETROFIT KIT

(71) Applicant: Balanced Body, Inc., Sacramento, CA (US)

(72) Inventors: Ken Endelman, Sacramento, CA (US); John R. Wahl, Hardeeville, SC (US)

(73) Assignee: Balanced Body, Inc., Sacramento, CA (US)

( * ) Notice: Subject to any disclaimer, the term of this patent is extended or adjusted under 35 U.S.C. 154(b) by 120 days.

(21) Appl. No.: 18/603,548

(22) Filed: Mar. 13, 2024

(65) Prior Publication Data

US 2025/0288866 A1 Sep. 18, 2025

(51) Int. Cl.

| | |
|---|---|
| ***A63B 22/20*** | (2006.01) |
| ***A63B 21/00*** | (2006.01) |
| ***A63B 21/005*** | (2006.01) |
| ***A63B 24/00*** | (2006.01) |

(52) U.S. Cl.

CPC ..... *A63B 22/203* (2013.01); *A63B 21/0058* (2013.01); *A63B 21/153* (2013.01); *A63B 21/4034* (2015.10); *A63B 24/0087* (2013.01); *A63B 2225/50* (2013.01)

(58) Field of Classification Search

CPC ..... A63B 21/00069; A63B 21/00076; A63B 21/0058; A63B 21/153; A63B 21/4034; A63B 21/4045; A63B 22/0087; A63B 22/0089; A63B 22/203; A63B 24/0087; A63B 2225/50

See application file for complete search history.

(56) References Cited

U.S. PATENT DOCUMENTS

| | | | | |
|---|---|---|---|---|
| 12,186,628 | B2 * | 1/2025 | Neuhaus | A63B 21/0058 |
| 2022/0296980 | A1 * | 9/2022 | Lagree | A63B 71/0036 |
| 2022/0362613 | A1 * | 11/2022 | Watterson | A63B 21/055 |
| 2022/0395718 | A1 * | 12/2022 | Lagree | A63B 21/0428 |
| 2023/0017705 | A1 * | 1/2023 | Lagree | A63B 21/00069 |
| 2023/0105920 | A1 * | 4/2023 | Neuhaus | A63B 24/0087 482/8 |
| 2023/0381577 | A1 * | 11/2023 | Mao | A63B 21/153 |

FOREIGN PATENT DOCUMENTS

| | | | | |
|---|---|---|---|---|
| KR | 20250043689 A | * | 3/2025 | A63B 21/023 |
| WO | WO-2024263188 A1 | * | 12/2024 | A63B 22/0089 |

* cited by examiner

*Primary Examiner* — Gary D Urbiel Goldner
(74) *Attorney, Agent, or Firm* — Greenberg Traurig, LLP

(57) ABSTRACT

A reformer exercise apparatus includes a frame having one or more rails spaced between a head end and a foot end of the frame, a carriage supported on the one or more rails for reciprocal movement of the carriage between the head end and the foot end of the frame, and an inverted U shaped foot bar carried by the one or more rails and selectively positionable near the foot end of the frame. The apparatus has an electrical motor and controller assembly fastened to the carriage that drives a cord member removably coupled from the motor on the carriage to an anchor fastened to the foot end of the frame. This motor is operable to continuously bias the cord member on the carriage toward the foot end of the frame. The motor and controller assembly alternately form a retrofit kit for replacement of springs on a conventional reformer.

17 Claims, 3 Drawing Sheets

MOTORIZED REFORMER EXERCISE APPARATUS AND RETROFIT KIT

BACKGROUND

Reformers utilized in performance of exercise inspired by Joseph Pilates almost a hundred years ago almost all utilize some combination of a plurality of coil springs to bias a movable carriage toward a foot end of a generally rectangular frame that typically rests upon a horizontal surface such as a floor. The user can stand on the carriage or stand standing between the foot end and the carriage, or sit or lie on the carriage or a box resting on the carriage to perform hundreds of different exercises.

These springs each has a specific resistance profile from a relaxed state to a stretched state that generally reflects a linear spring rate of tension. A typical reformer carries five or six springs each having a different spring rate, with each having one end fastened to the carriage and the other end connectable to one of an array of anchor pins or hooks fastened to the foot end of the reformer frame. Because each of these springs has a different spring rate, this provides a user or instructor the ability to select upwards of 75-80 different spring combinations to utilize in a given exercise.

To change the combination of springs a reformer user often must dismount from the carriage or step off of the reformer in order to unhook and rehook a different combination of springs to the anchors at the foot end of the frame. The longevity of springs on a reformer is also finite, and depends on the level of use, age, etc. Thus many reformer manufacturers recommend periodic replacement of spring sets to ensure continued predictable performance levels of the springs. Coil springs generally exhibit a linear rate of resistance during extension. Especially during rehabilitation from injury, a user may desire a nonlinear rate of resistance during extension which is not possible when using coil springs. For these reasons, and others, there is a need for a reformer that utilizes a more adjustable form of generating applied tension and resistance. However, for almost a hundred years now, nothing has been suggested that addresses this need.

SUMMARY OF THE DISCLOSURE

A reformer exercise apparatus in accordance with the present disclosure addresses this need. Furthermore, a conventional reformer that utilizes coil springs can also be easily converted to operate in accordance with the present disclosure by replacing the existing springs with a retrofit kit as described below.

An exemplary reformer exercise apparatus in accordance with this disclosure includes a frame having one or more rails, preferably a pair of parallel rails, spaced apart between a head end and a foot end of the frame, a carriage supported on the parallel rails for reciprocal movement of the carriage between the head end and the foot end of the frame, and an inverted U shaped foot bar carried by the parallel rails and selectively positionable near the foot end of the frame. The apparatus includes a motor fastened to the carriage driving a cord member removably coupled from the motor on the carriage to an anchor fastened to the foot end of the frame. This motor continuously biases the carriage toward the foot end of the frame via the cord member. The reformer exercise apparatus preferably also includes a controller coupled to the motor for selectively changing bias between the carriage and the foot end of the frame. In one embodiment the motor is a three phase DC motor. In one embodiment the controller may be wirelessly operated or adjusted by a user.

Preferably the motor and the controller are carried within a housing fastened to an underside surface of the carriage. One end of the cord member is wound around a reel rotatably fastened to the motor in the housing. A distal end of the cord member extends out of the housing so as to be removably fastened to the anchor at the foot end of the frame. The reel is fastened to a shaft of the motor and is oriented perpendicular to a surface of the carriage.

In one embodiment, a retrofit kit is provided for replacing springs in a reformer exercise apparatus having a generally rectangular frame having two parallel side rails spaced apart by a head end member and a foot end member and a carriage supported by the two parallel side rails and biased toward the foot end member by the one or more springs extending from the carriage to an anchor on the foot end member of the generally rectangular frame. This retrofit kit includes a housing configured to be fastened to an underside surface of the carriage, a motor carried in the housing, and a reel mounted cord member fastened to a driven shaft of the motor. The reel mounted cord member has a distal end extending through an opening in the housing. The motor applies a continuous torque against rotation of the driven shaft and thereby applies a bias to the reel mounted cord member. The cord member includes an attachment member fastened to the distal end of the reel mounted cord member for engaging the anchor.

The retrofit kit preferably includes a controller in the housing operable to selectively control a magnitude of the continuous torque applied by the motor to the reel mounted cord member in order to simulate resistance force generated by one or more springs connected between the carriage and the anchor on the foot end member of the generally rectangular frame. The motor preferably is a three phase brushless DC motor and may be a stepper motor.

The attachment member may be a ring affixed to the distal end of the reel mounted cord member configured to be removably attached to the anchor at the foot end member of the reformer exercise apparatus. The retrofit kit also preferably includes a power supply coupled to the controller and the motor in the housing. This power supply preferably includes one of a household electrical current connectable supply or a battery. The retrofit kit may also include a hand held actuator for a user to select a desired magnitude of the continuous torque applied to the reel mounted cord member. This hand held actuator may be wirelessly actuated and may be configured to select torque values representative of one to 5 springs being connected between the carriage and the foot end member of the rectangular frame when the retrofit kit is installed on a reformer exercise apparatus.

DETAILED DESCRIPTION

Figure 1:
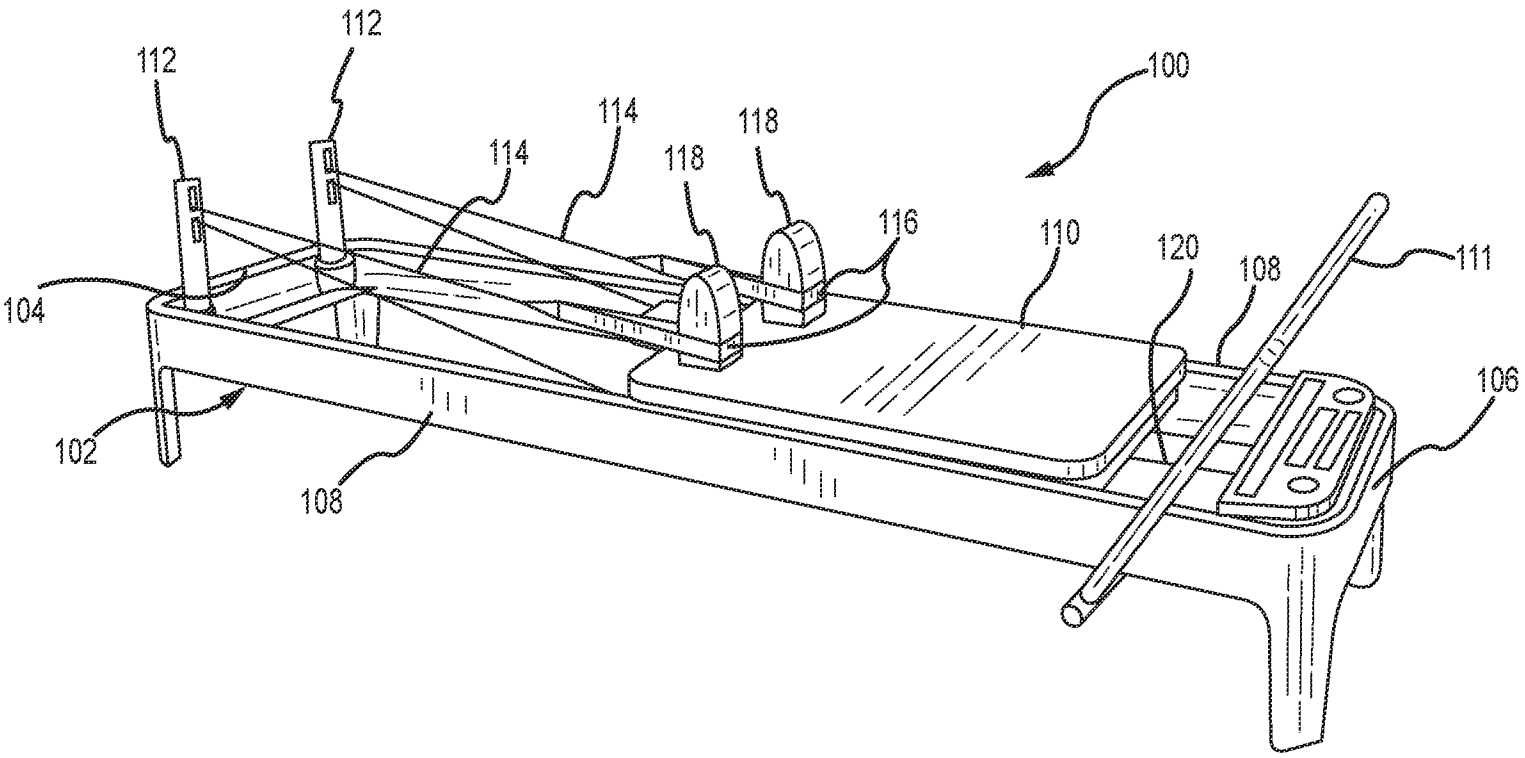
FIG. 1 is a perspective view of one embodiment of a reformer exercise apparatus in accordance with the present disclosure.

A perspective view of one exemplary embodiment of a reformer exercise apparatus 100 in accordance with the present disclosure is shown in FIG. 1. The apparatus 100 has a generally rectangular frame 102 with a head end 104 and a foot end 106. The ends 104 and 106 are spaced apart by a pair of rail members 108. A carriage 110 is movably supported on the rail members 108 for reciprocal movement back and forth between the ends 104 and 106 of the frame 102.

An inverted U shaped foot bar 111 is positioned near the foot end 106 of the frame 102. This foot bar 111 is carried by the rail members 108 and, in this embodiment, is configured to be selectively positioned adjacent the foot end 106 and/or optionally relocated to various locations along the rail members 108 between the foot end 106 and head end 104. Operation and construction of this reformer 100 is described in detail in U.S. Pat. No. 8,721,511, owned by Balanced Body, Inc. and incorporated herein by reference in its entirety.

The head end 104 of the frame 102 preferably supports a removable pair of spaced upright arm cord support risers 112. These risers 112 direct arm cords 114 from the carriage 110 to cord end loops 116 or grips for a user's hands for use in various exercises. When not in use, the end loops 116 may be conveniently positioned on the shoulder stops 118 as shown in FIG. 1. The carriage 110 is resiliently biased toward the foot end 116 of the frame 102 by a motor and controller assembly 150 (See FIG. 3) driving a motor driven cord member 120 as will be further described below.

Figure 2:
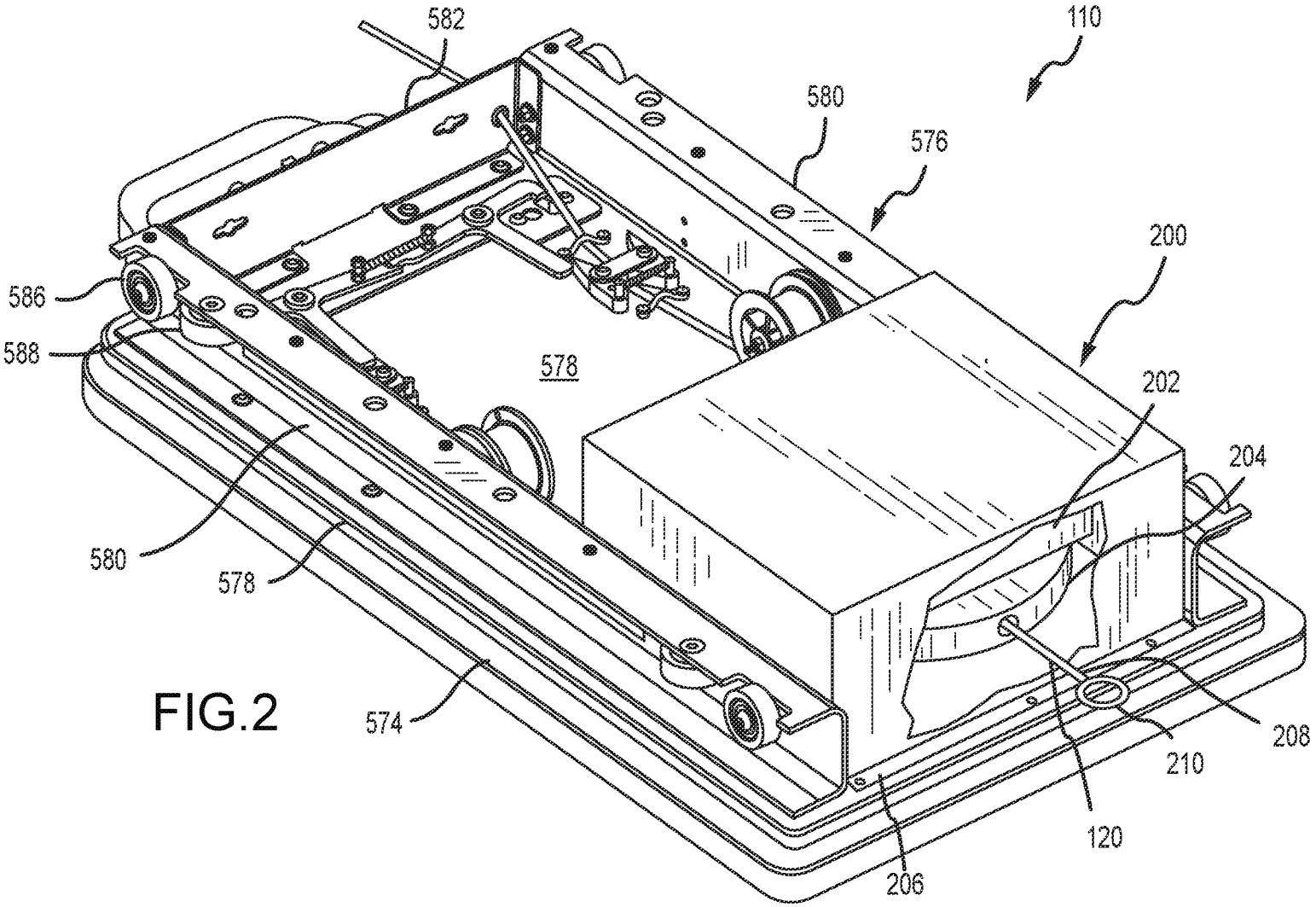
FIG. 2 is a separate perspective underside view of the carriage removed from the exercise apparatus shown in FIG. 1.

An underside separate perspective view of the carriage 110 is separately shown in FIG. 2. The carriage 110 includes a generally rectangular frame 576, a rectangular support platform 578, the upholstered upper platform 574, and a pair of shoulder stops 118 (FIG. 1). The frame 576 has upright side support plates 580, a vertical head end plate 582 and a vertical support plate 584, both of which are fastened to the side support plates 580. All of these plates 580, 582 and 584 are also fastened to the underside of the support platform 578 to provide a rigid carriage structure.

Instead of springs attached to the vertical support plate 584, as in the U.S. Pat. No. 8,721,511 discussed above, in the present disclosure the set of springs has been removed. Instead, a motor housing 200 is bolted to the underside surface of the support platform 578 via screws through holes in an external flange 206 of the housing 200. This motor housing 200 contains a motor and controller assembly 150. The motor and controller assembly 150 includes a three phase DC motor 202 and a cord reel 204 on which is wound a cord 120. This cord 120 has a distal end 208 to which is fastened an attachment member, in this embodiment, a ring 210. This ring 210 is outside the housing 200. The cord 120 extends from the cord reel 204 through an opening in a side wall of the housing 200 facing the foot end 106 of the reformer frame 102. The ring 210 on the cord 120 is fastened to the foot end 106 of the reformer frame 102 in place of a spring such that the carriage 110 may be continuously biased toward the foot end 106 by the cord 120.

Figure 3:
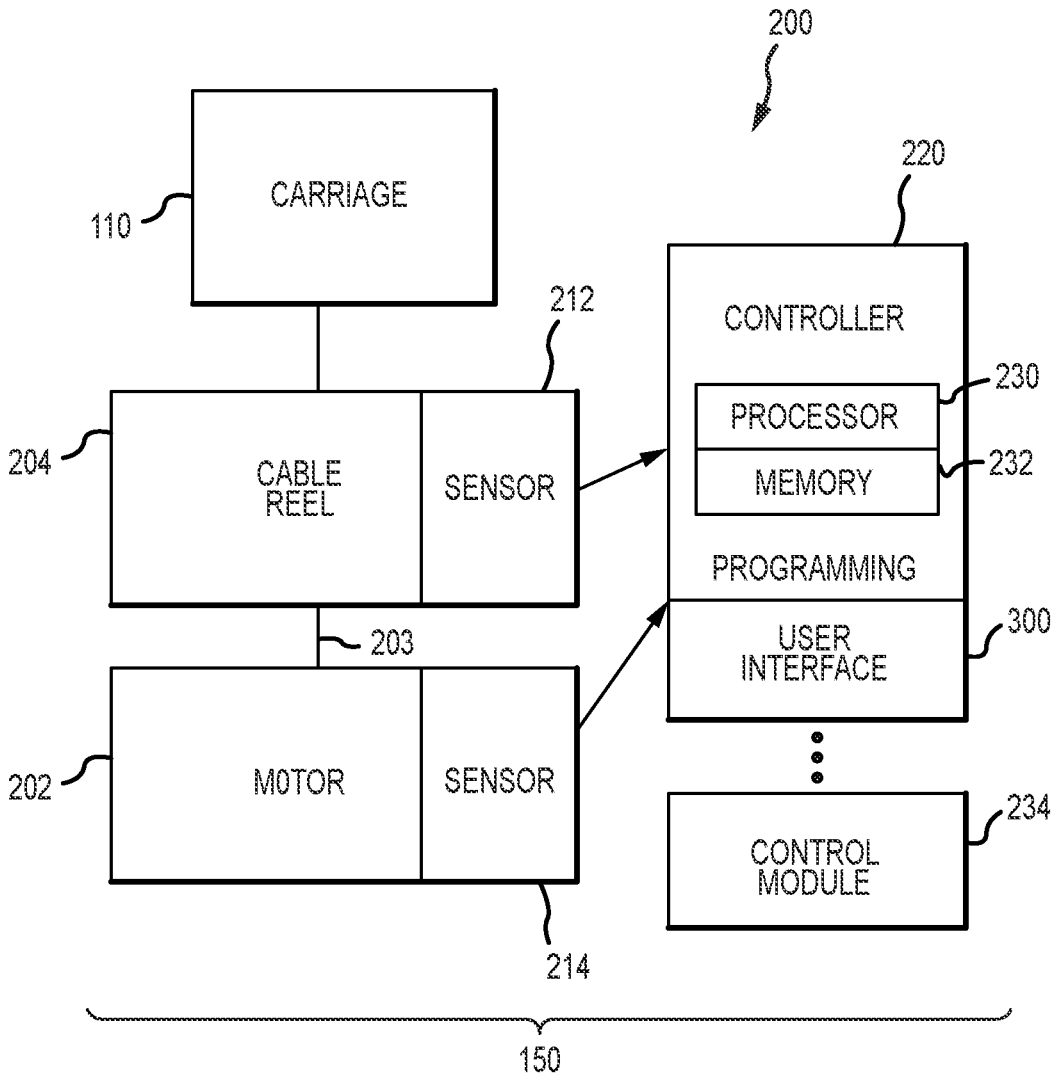
FIG. 3 is a block diagram of the components within the motor housing on the carriage shown in FIG. 2.

A schematic block diagram of the motor and controller assembly 150 within the housing 200 is shown in FIG. 3. The assembly 150 within the housing 200 includes the motor 202 having a shaft 203 driving the cord reel 204, positional sensors 212 and 214 and a controller 220.

Motor 202 may be a DC or AC motor. However, a 3 phase DC stepper motor is preferred as this type of motor can be precisely controlled and can produce high torque. One such motor and its control scheme is described in detail in U.S. Pat. No. 10,661,112, owned by Tonal Systems, Inc. which is incorporated herein by reference in its entirety.

The motor 202 is fastened to the housing 200 which is in turn fastened to the carriage 110 in the embodiment shown in FIG. 1. This motor 202 and the controller 220 may be battery powered or may be connected to a suitable household AC power source via standard connections.

The motor shaft 203 is preferably directly coupled to the cord reel 204. However, it could be coupled through a set of reduction gears depending on the overall size of the housing 200 required, for example, for use as a retrofit kit used as a replacement of a spring set in a conventional reformer geometry. The cord reel 204 may be mounted directly to the underside surface of the carriage or may be fastened to the housing 200. The cord reel 204 may be oriented so as to rotate about an axis perpendicular to or parallel to the surface of the carriage and is preferably configured to provide 4-6 wraps of cord or cable therearound in order to accommodate a carriage travel of about 3-4 feet on a typical reformer having an overall length of about 7-8 feet. For example, 4 wraps on a reel having a spool diameter of 4 inches will yield a maximum cord or cable travel distance of about 50 inches, more than enough for full carriage travel on any reformer known to date.

A distal end of the cord 120 protruding out of the housing 200 in the embodiment shown in FIGS. 1-2 has a ring 210 fastened thereto configured to slip onto an anchor pin or hook fixed to the foot end 106 of the reformer 100. This ring configuration is also appropriate for installation of the housing 200 of the motor and controller assembly 150 in place of spring sets carried underneath the carriage of most conventional wood reformers, as a retrofit kit, because most anchor devices are simply hooks extending from a metal anchor bar extending across the foot end of the wood reformer frame.

In the embodiment shown in FIGS. 1-2, motor 202 is mounted directly to the carriage 110 via housing 200. This housing 200 also encloses the reel 204 and a controller 220. A simplified block diagram of the control system is shown in FIG. 3. The controller 220 produces current that drives the motor 202 in accordance with a desired level of torque dialed in by a user utilizing a user interface 300.

This user interface 300 permits the user to input a desired force, for example, in pounds force or other recognizable units. The controller 220, in turn, converts the desired torque into current to be applied to the 3 phase DC stepper motor 202.

Without the user pushing against the foot bar 111 or other structure, or pulling the arm cords 114, the carriage 110 is biased, or held, by the motor 202 adjacent the foot end 106 of the frame 102 against one or more stops (not shown) at the foot end 106 with a force equivalent to the desired resistance input by the user.

A user pushes against the foot bar 111 or pulls arm cords 114 to move the carriage 110 away from the foot end 106 of the frame 102 along the rails 108. When the force generated by the user exceeds the motor torque, i.e. as the force on the cord/cable 120 overdrives torque produced on the motor shaft by the motor 202 the carriage 120 will move in this manner away from the foot end 106 of the frame 102 just as a user on the carriage 110 exerting force against one or more springs attached to the foot end 106 would.

In some embodiments, the controller 220 may be configured to apply a programmed time variational torque to the motor 202 rather than a constant rate of resistance, i.e. torque, in replication of force generated by a desired combination of coil springs.

Sensor 212 provides an input to controller 220 corresponding to stepper motor 202 shaft position. Sensor 214 provides an input to controller 220 of cable 120 position on the reel 204.

Controller 220 preferably includes a microprocessor 230, memory 232 storing appropriate programming to generate the requisite current in the stepper motor 202 to produce the desired torque, and an input/output interface 300 to a wireless control module 234 that is, for example, held by the user or, for example, worn on the user's wrist or mounted somewhere handy to the user such as on one of the shoulder stops 118 on the carriage 110.

Many changes and alternative embodiments can be made to the reformer exercise apparatus 100 in accordance with the present disclosure specifically described above. For example, the housing 200 and motor 202 could alternatively be mounted to the foot end 106 of the reformer frame 102 with the free end of the cord 120 secured to a suitable anchor fastened to the carriage 110 instead of vice versa. Further, the controller 220 may be fastened to the carriage outside the housing 200.

In another alternative embodiment, not shown, the motor and controller assembly 150 could be configured with the cable 120 routed from the carriage 110, around one or more pulleys located at each of the head end 104 and foot end 106 of the reformer 100 and back to the carriage 110. In such a configuration the controller 220 could be configured to adjust and control resistance force applied by the motor 202 in opposition to force applied by a user in either direction toward or away from either the head end 104 or the foot end 106 of the reformer 100.

Many such modifications, variations and alternatives will become apparent to a reader of the above specification when taken in conjunction with the accompanying drawing Figures. Accordingly, all such alternatives, variations and modifications are intended to be encompassed within the scope of and as defined by the following claims.

What is claimed is:

1. A reformer exercise apparatus comprising:

a frame having one or more rails spaced apart between a head end and a foot end of the frame;

a carriage supported on the one or more rails for reciprocal movement of the carriage between the head end and the foot end of the frame;

an inverted U shaped foot bar carried by the one or more rails and selectively positionable near the foot end of the frame; and a motor being a three phase DC motor fastened to the carriage and driving a cord member removably coupled from the motor on the carriage to an anchor fastened to the foot end of the frame, wherein the motor is operable to continuously bias the carriage toward the foot end of the frame via the cord member.

2. The reformer exercise apparatus according to claim 1 further comprising a controller coupled to the motor for selectively changing bias applied to the cord member extending between the carriage and the foot end of the frame.

3. The reformer exercise apparatus according to claim 2 wherein the controller is wirelessly operated by a user.

4. The reformer exercise apparatus according to claim 2 wherein the motor and the controller are carried within a housing fastened to an underside surface of the carriage and wherein one end of the cord member is wound around a reel rotatably fastened to the motor in the housing and wherein a distal end of the cord member extends out of the housing so as to be removably fastened to the anchor at the foot end of the frame.

5. The reformer exercise apparatus according to claim 4 wherein the reel is fastened to a shaft of the motor oriented perpendicular to a surface of the carriage.

6. A retrofit kit for replacing springs in a reformer exercise apparatus having a generally rectangular frame having two parallel side rails spaced apart by a head end member and a foot end member and a carriage supported by the two parallel side rails and biased toward the foot end member by one or more springs extending from the carriage to an anchor on the foot end member of the generally rectangular frame, the retrofit kit comprising:

a housing configured to be fastened to an underside surface of the carriage;

a motor being a three phase brushless DC motor carried in the housing;

a reel mounted cord member fastened to a driven shaft of the motor, wherein the reel mounted cord member has a distal end extending through an opening in the housing, wherein the motor applies a continuous torque against rotation of the driven shaft and thereby to the reel mounted cord member; and an attachment member fastened to the distal end of the reel mounted cord member for engaging the anchor.

7. The retrofit kit according to claim 6 further comprising a controller in the housing operable to selectively control a magnitude of the continuous torque applied by the motor to the reel mounted cord member in order to simulate resistance force generated by the one or more springs connected between the carriage and the anchor on the foot end member of the generally rectangular frame.

8. The retrofit kit according to claim 6 wherein the motor is a stepper motor.

9. The retrofit kit according to claim 6 wherein the attachment member is a ring affixed to the distal end of the reel mounted cord member configured to be removably attached to the anchor at the foot end member of the reformer exercise apparatus.

10. The retrofit kit according to claim 7 further comprising a power supply coupled to the controller and the motor in the housing.

11. The retrofit kit according to claim 10 wherein the power supply includes one of a household electrical current connectable supply or a battery.

12. The retrofit kit according to claim 10 further comprising a hand held actuator for a user to select a desired magnitude of the continuous torque applied to the reel mounted cord member.

13. The retrofit kit according to claim 12 wherein the hand held actuator is wireless.

14. The retrofit kit according to claim 12 wherein the hand held actuator is configured to select torque values representative of the one or more springs being connected between the carriage and the foot end member of the reformer exercise apparatus when the retrofit kit is installed on the reformer exercise apparatus.

15. A reformer exercise apparatus comprising:

a frame having a pair of parallel rails spaced apart between a head end and a foot end of the frame;

a carriage supported on the pair of parallel rails for reciprocal movement of the carriage between the head end and the foot end of the frame;

an inverted U shaped foot bar carried by the pair of parallel rails and selectively positionable near the foot end of the frame; and a motor being a three phase brushless DC stepper motor fastened to the carriage and driving a cord member removably coupled from the motor on the carriage to an anchor fastened to the foot end of the frame, wherein the motor is operable to continuously bias the carriage toward the foot end of the frame via the cord member.

16. The reformer exercise apparatus according to claim 15 further comprising a controller coupled to the motor for selectively changing bias applied to the cord member extending between the carriage and the foot end of the frame.

17. The reformer exercise apparatus according to claim 16 wherein the controller is wirelessly operated by a user.

* * * * *